United States Patent [19]

Nozaki et al.

[11] 4,396,798

[45] Aug. 2, 1983

[54] HIGH TENSILE STRENGTH SUSPENSION INSULATORS WITH MULTI-STEP EMBEDDED PINS

[75] Inventors: Hiroshi Nozaki; Haruo Inoue, both of Nagoya, Japan

[73] Assignee: NGK Insulators, Ltd., Nagoya, Japan

[21] Appl. No.: 311,951

[22] Filed: Oct. 16, 1981

[30] Foreign Application Priority Data

Oct. 22, 1980 [JP] Japan ..... 55-147718

[51] Int. Cl.[3] ..... H01B 17/02

[52] U.S. Cl. ..... 174/196; 174/182

[58] Field of Search ..... 174/140 C, 141 R, 141 C, 174/150, 180, 182, 189, 194, 195, 196

[56] References Cited

U.S. PATENT DOCUMENTS 1,832,157 11/1931 Van Atta ..... 174/196 X 1,958,880 5/1934 Arnold ..... 174/196 X

*Primary Examiner*—Laramie E. Askin

*Attorney, Agent, or Firm*—Parkhurst & Oliff

[57] ABSTRACT

The suspension insulator of the present invention has an improved shape of the embedding portion of a metal pin, which is an embedding multi-step portion constructed with an inverted spherical convex trapezoid upper expanded portion having a larger surface at the top end and an inverted frust-conical lower expanded portion succeeding to the upper expanded portion. By using such a metal pin, the stress distribution of the insulating body is made uniform and therefore a small size and light weight of suspension insulator having high tensile strength is obtained.

2 Claims, 7 Drawing Figures

HIGH TENSILE STRENGTH SUSPENSION INSULATORS WITH MULTI-STEP EMBEDDED PINS

BACKGROUND OF THE INVENTION

The present invention relates to suspension insulators having excellent tensile strength and particularly to the form of an embedding multi-step portion of a metal pin.

The suspension insulator is usually one wherein cap hardware is provided at an insulating body head and an embedding expanded portion at an upper end of a metal pin is embedded in and secured to a pin assembling hole provided in the insulating body with cement. It has been known that the tensile strength of such a suspension insulator is greatly influenced by the shape of the embedding portion positioned in the pin assembling hole. When a tensile load is applied to the suspension insulator, a compression force acts on a side wall of a ceramic insulating body head owing to a wedge effect of the cap hardware and the metal pin, and a stress is distributed on the side wall of said head portion owing to this compression force. When the maximum tensile stress value exceeds the specific tensile stress of the head portion of the ceramic insulating body, the insulating body is broken. Since, in the suspension insulator, the maximum tensile stress point is located near a boundary portion between the upper surface and the inside surface of the pin assembling hole provided in the insulating body in view of the mechanism, the shape of the embedding portion at the upper end of the metal pin has an important role in influencing the tensile strength. In prior metal pins of such a suspension insulator, a metal pin which has a spherical convex trapezoid expanded portion 11 (hereinafter called "R-shaped") as shown in FIG. 6, A, and a tapered metal pin which is an inverted frusto-conical expanded portion 12 as shown in FIG. 6, B, have been usually adopted as the shape of the embedding portion provided at the top end of the metal pin. In the former, the stress concentration to the insulating body is reduced by the spherical convex portion, so that aging deterioration of the insulating body can be prevented; but in order to develop a satisfactory wedge effect, the expanded portion should have a fairly large size and this is not preferable in view of making the entire suspension insulator of small size and light weight. On the other hand, the latter develops a satisfactory wedge effect but the insulating body readily causes aging deterioration due to the stress concentration.

SUMMARY OF THE INVENTION

An object of the present invention is to provide suspension insulators which can realize the tensile strength of the insulating body to the maximum limit by developing metal pins not having the above described defects.

The present invention provides suspension insulators wherein the shape of the embedding expanded portion of the metal pins is improved. In more detail, the embedding expanded portion of the metal pins is constructed in a multi-step. In particular, the present invention provides suspension insulators provided with a metal pin having an embedding multi-step portion at the upper end which is constructed with an inverted spherical convex trapezoid upper expanded portion, the top end of which is a larger surface, and an inverted frusto-conical lower expanded portion.

In the more preferred embodiment of the present invention, a curvature radius at the side surface of the inverted spherical convex trapezoid upper expanded portion is 40–80% of a diameter of the larger bottom surface and a taper angle $\theta$ of the inverted frusto-conical lower expanded portion is 15°–35°.

BRIEF DESCRIPTION OF THE DRAWINGS

For a better understanding of the invention, reference is made to the accompanying drawings.

DESCRIPTION OF THE PREFERRED EMBODIMENTS

A detailed explanation will be made with respect to a clevis type suspension insulator as an example, but this example is not intended as limitation thereto.

Figure 1:
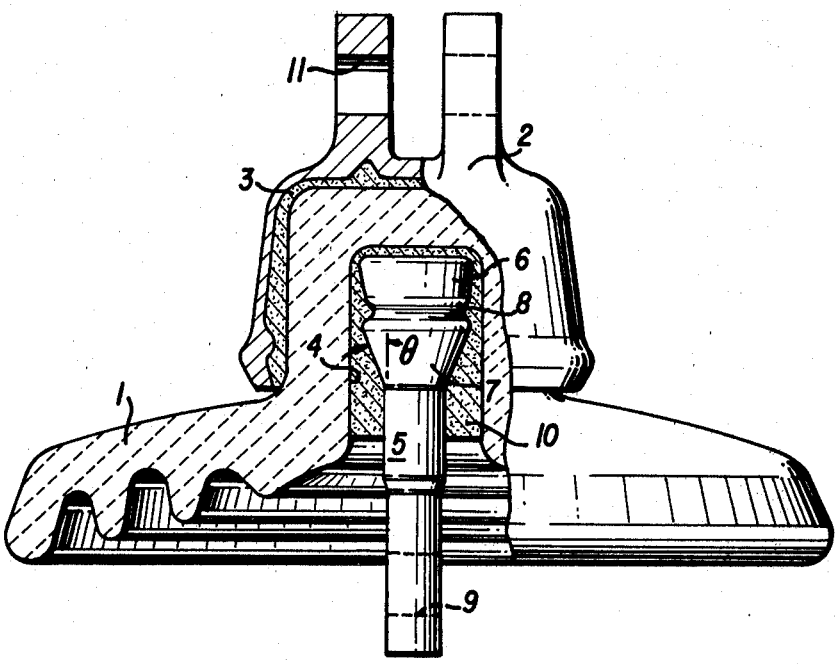
FIG. 1 is a partially broken away front view showing an embodiment of the present invention.

Referring to FIG. 1, the numeral 1 is a ceramic insulating body to which cap hardware 2 is fixed with cement 3. A pin assembling hole 4 is opened downwardly at a center portion of the insulating body 1 so as to fit the outer contour of the head portion of the insulating body 1. The numeral 5 is a metal pin and at the upper end of the metal pin 5 is provided an embedding multi-step portion 8 wherein an inverted spherical convex trapezoid upper expanded portion 6 having a larger surface at the upper side is provided and one or more inverted frusto-conical lower expanded portions 7 are provided succeeding to the upper expanded portion 6. The metal pin 5 is embedded in and secured to the above described pin assembling hole 4 by inserting the upper embedding multi-step portion 8 into the pin assembling hole and filling a cement 10 between the upper embedding multi-step portion 8 and the metal pin assembling hole 4. The numeral 9 is a pin hole provided at the lower end of the metal pin 5 and the numeral 11 is a pin hole provided at the upper end of the cap hardware 2.

The thus formed suspension insulator is pivotally secured to a metal support provided in an iron tower with the cap hardware 2 and a line side yoke is pivotally secured to a lower end of the metal pin 5 in the same manner as in the prior suspension insulators. In the metal pin 5 according to the present invention, the embedding multi-step portion 8 provided at the top end of said metal pin, which is constructed with the inverted spherical convex trapezoid upper expanded portion 6 and the inverted frusto-conical lower expanded portion 7 succeeding thereto, is embedded in and secured to the pin assembling hole 4 provided in the insulating body 1 with the cement 10, so that the suspension insulator has the following features. That is, the upper portion of the metal pin 5 is the embedding multi-step portion 8 and the lower expanded portion 7 is the inverted frusto-conical form having an excellent wedge effect, so that even if the diameters of the upper expanded portion 8 and the lower expanded portion 7 are smaller, the wedge effect is not deteriorated, so that the present invention is effective for obtaining a suspension insulator in which the entire is of small size and light weight. The upper expanded portion 6, positioned near the boundary portion of the upper surface and the inside portion of the pin assembling hole 4 which is the maximum tensile stress point of the insulating body 1, is the inverted spherical convex trapezoid form in which the upper side is the larger surface. Thus, the stress concentration against the insulating body 1 is reduced owing to the spherical convex side portion and the upper portion of the metal pin having a multi-step shape, so that the stress distribution of the insulating body 1 is made uniform and the maximum tensile stress value is reduced.

Figure 6:
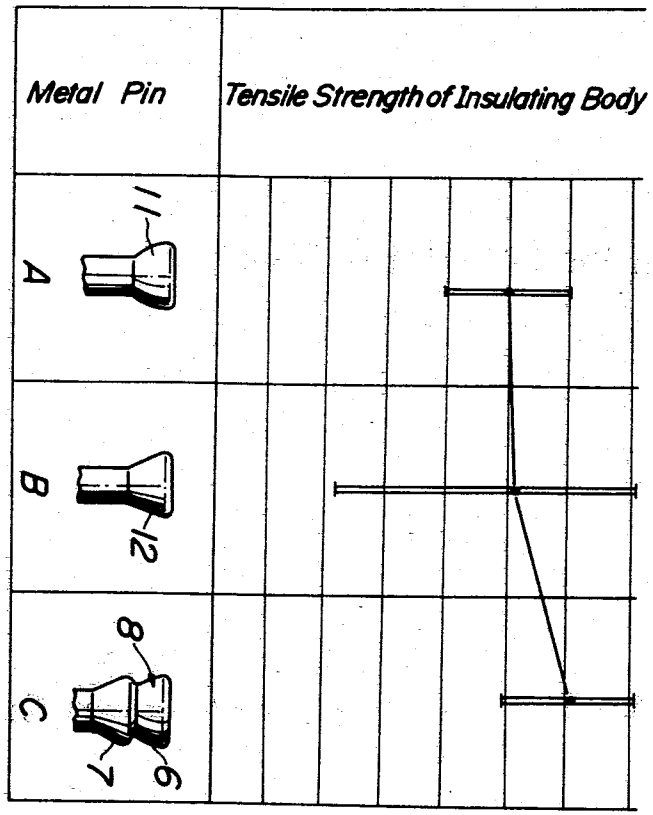
FIG. 6 is a graph showing the comparison of the tensile strength of the insulating body according to the present invention with those of each insulating body in prior suspension insulators.

With respect to 20 samples of each of two kinds of conventional suspension insulators wherein an R-shaped metal pin, and a tapered metal pin having a tensile strength of more than the breaking strength of the insulating body are provided in ceramic insulating bodies having M and E rating of 33 tons, and a suspension insulator according to the present invention, a test for determining the tensile strength of the insulating body was made and the results are shown in FIG. 6. When the tensile strength of the insulating body of the suspension insulator shown in column C according to the present invention is compared with that of the conventional suspension insulators using the R-shaped metal pin shown in column A and the tapered metal pin shown in column B, the tensile strength according to the present invention is about 1.2 times that of the conventional suspension insulators in mean value and the unevenness in 20 samples is low and the reliability is high. Thus, the present invention has been confirmed in that the use of the metal pin 5, provided with the embedding multi-step portion 8 at the upper portion which is constructed with the inverted spherical convex trapezoid upper expanded portion 6 and the inverted frusto-conical lower expanded portion 7 succeeding thereto, can provide a suspension insulator in which the insulating body 1 has an excellent tensile strength.

Figure 2:
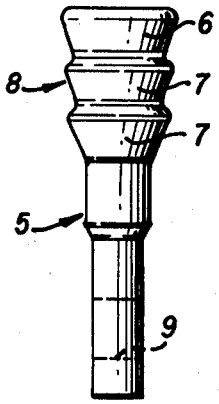
FIG. 2 is a front view showing another embodiment of a metal pin according to the present invention.
Figure 3:
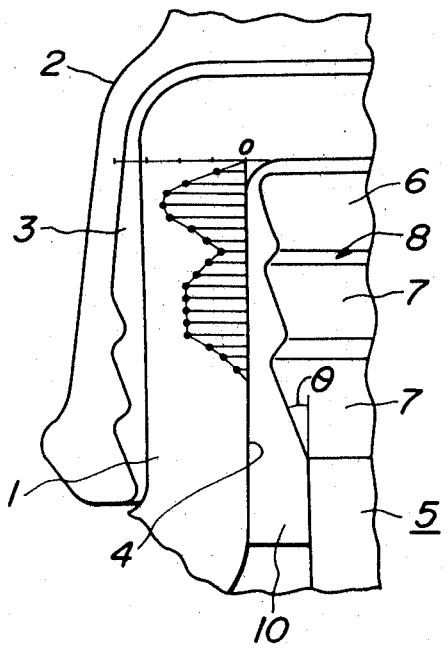
FIG. 3 is an explanatory partial sectional view showing the results of analysis of the stress distribution of the insulating body according to the present invention by using the finite element method.
Figure 5:
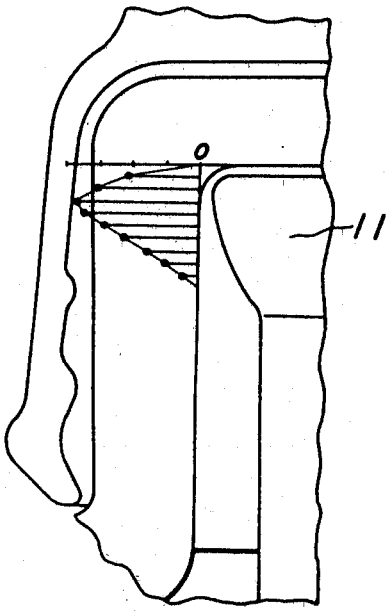
FIG. 5 is an explanatory partial sectional view showing the result obtained by analyzing the stress distribution of the insulating body in a prior suspension insulator using a metal pin with a spherical convex trapezoid expanded portion by the finite element method.

The metal pin 5 in which the embedding multi-step portion 8 is provided at the upper end has a tensile strength higher than the conventional metal pins. This is because the stress distribution of the insulating body is made uniform and the maximum tensile stress is lowered. When the stress distribution is analyzed by the finite element method with respect to a three-step pin as shown in FIG. 2, the result as shown in FIG. 3 is obtained. On the other hand, the conventional suspension insulator using an R-shaped metal pin shows the result depicted in FIG. 5. In the present invention, the stress distribution in the axial direction of the pin assembling hole which greatly influences upon the tensile strength of the insulating body, is made uniform and the maximum tensile stress in the product of the present invention is greatly reduced. The embedding multi-step portion 8 of the metal pin 5 in the present invention is constructed with the inverted spherical convex trapezoid upper expanded portion 6 having a larger surface at the upper side and the inverted frusto-conical lower expanded portion 7 succeeding to the upper expanded portion 6. Thus, only one inverted spherical convex trapezoid upper portion 6 is provided at the most upper portion; only one inverted frusto-conical lower expanded portion 7 may be provided as shown in FIG. 1, or in the case where the height of the head portion is large as in a suspension insulator having an ultra high strength rating, a plurality of the expanded portions may be provided as shown in FIG. 2.

Figure 4:
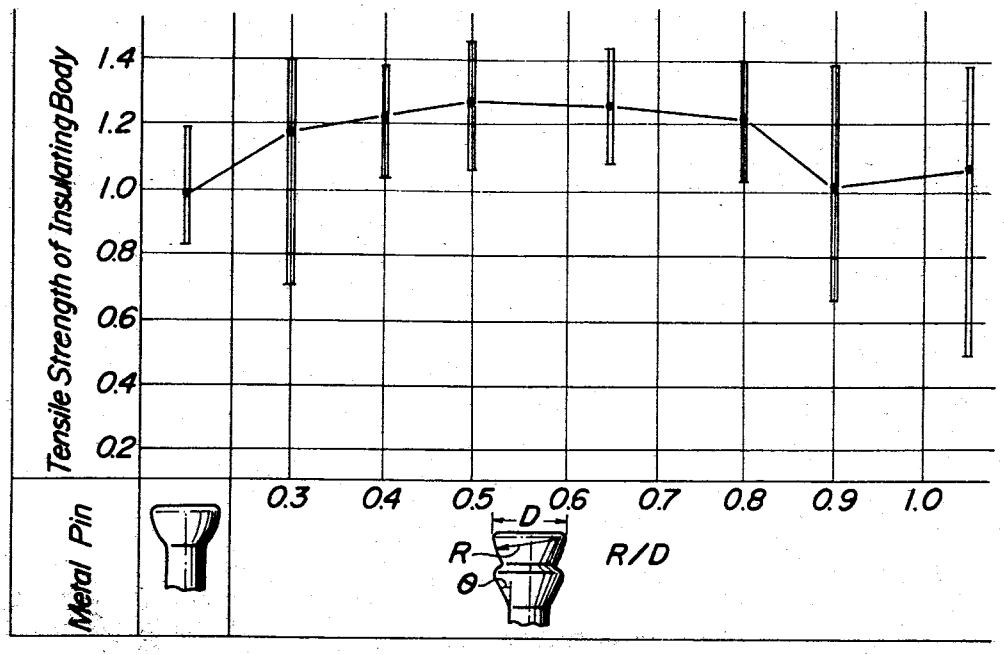
FIG. 4 is a graph showing the variation of the tensile strength when the ratio of the curvature radius of the upper expanded portion to the diameter of the larger bottom surface of the upper expanded portion is varied.
Figure 7:
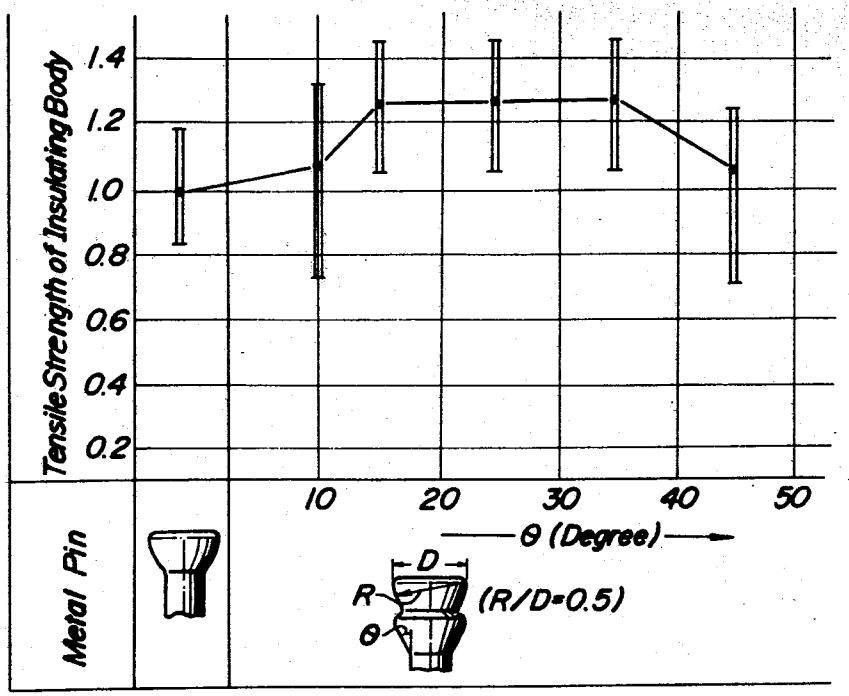
FIG. 7 is a graph showing the relation of the tensile strength to the taper angle ($\theta$) of the lower expanded portion.

The curvature radius of the upper expanded portions 6 and the taper angle of the lower expanded portion 7 may vary depending upon the shape of the insulating body 1 and the pin assembling hole 4 and are not particularly limited. However, in the typical clevis type suspension insulator as shown in FIG. 4, when a curvature radius R of the side surface of the upper expanded portion 6 is within a range of 40–80% of a diameter D at the upper surface of the upper expanded portion 6, the most stable tensile strength can be developed. On the other hand, as shown in FIG. 7, when a taper angle $\theta$ of the side surface in the lower expanded portion 7 is within a range of 15°–35°, the most pertinent stress can be supported. It is most preferable that the shapes of the upper expanded portion 6 and the lower expanded portion 7 are made to be within the above described ranges.

As clarified by the explanation with reference to the above described example, the present invention can develop the tensile strength of the insulating body to the maximum limit by constructing the embedding multi-step portion with the inverted spherical convex trapezoid upper portion at the upper end of the metal pin and the inverted frusto-conical lower expanded portion succeeding thereto. The stress distribution of the insulating body is made uniform and even if the outer diameters of the upper expanded portion and the lower expanded portion are made to be smaller than the diameter of the upper end expanded portion of a metal pin with a spherical convex trapezoid expanded portion embedded and secured in the conventional suspension insulator, the wedge effect is not deteriorated. This is advantageous in order to make the size and the weight of the entire suspension insulator to be small and light while the defects of this type of prior suspension insulators are obviated. Thus the present invention is very commercially important.

What is claimed is:

1. In a suspension insulator in which an embedding portion provided at a top end of a metal pin is embedded in and secured to a pin assembling hole provided in an insulating body with a cement, the improvement comprising constructing said embedding portion with an inverted spherical convex trapezoid upper expanded portion having a larger surface at the top end and at least one inverted frusto-conical lower expanded portion succeeding to the upper expanded portion, wherein a curvature radius of a side surface of the inverted spherical convex trapezoid upper expanded portion is 40–80% of a diameter of said larger surface, and a taper angle $\theta$ of a side surface of the inverted frusto-conical lower expanded portion is 15°–35°.

2. The suspension insulator of claim 1, wherein said diameter of said larger surface is greater than a largest diameter of said frusto-conical lower expanded portion.

* * * * *